US005179387A

United States Patent [19]

Wells

[11] Patent Number: 5,179,387

[45] Date of Patent: Jan. 12, 1993

[54] WHIP ANTENNA OPERABLE WITHOUT GROUNDING

[76] Inventor: Donald H. Wells, 7134 Railroad St., Holland, Ohio 43528

[21] Appl. No.: 321,309

[22] Filed: Mar. 10, 1989

[51] Int. Cl.[5] ..... H01Q 1/36; H01Q 1/32

[52] U.S. Cl. ..... 343/895; 343/715; 343/749; 343/856

[58] Field of Search ..... 343/895, 749, 856, 715, 343/860, 900

[56] References Cited

U.S. PATENT DOCUMENTS

| | | | |
|---|---|---|---|
| 3,259,901 | 7/1966 | Bykerk | 343/749 |
| 4,028,704 | 6/1977 | Blass | 343/715 |
| 4,228,544 | 10/1980 | Guyton | 343/860 |
| 4,229,743 | 10/1980 | Vo et al. | 343/895 |
| 4,890,116 | 12/1989 | Lewis, Jr. | 343/749 |

OTHER PUBLICATIONS

Transmission Line Transformers by Gerry Sevick published by American Radio Relay League, Entire Book. The American Radio Relay League, 1985 Handbook, pp. 3-12, 3-11, 19-8 & 19-7.

*Primary Examiner*—Rolf Hille
*Assistant Examiner*—Hoanganh Le
*Attorney, Agent, or Firm*—William P. Hickey

[57] ABSTRACT

An antenna whip construction having a radiating or radiation receiving antenna element, and an isolation transformer electrically connected between the antenna element and the support fitting of the whip, and all of which is bound into a structural self supporting whip. The isolation transformer has a pair of input terminals for connection to a transmission line, and the isolation transformer allows feed through from one of the input terminals to the antenna element but effectively isolates the antenna element from the other of the input terminals.

18 Claims, 1 Drawing Sheet

WHIP ANTENNA OPERABLE WITHOUT GROUNDING

TECHNICAL FIELD

The present invention relates to the construction of a whip antenna that does not require grounding.

BACKGROUND OF THE INVENTION

Conventional whip antennas of less than a half wave length must be connected to some kind of a ground, so that the portion of the wave that extends out of the whip can flow in and out of the ground. If the grounding connection breaks or its resistance becomes large, the efficacy of the antenna is impaired. Conventional whips when mounted on nonmetallic bodies require elaborate grounding systems to be used therewith.

It is an object of the present invention to produce a whip antenna which will operate satisfactorily without an external ground.

Further objects and advantages will become apparent to those skilled in the art to which the invention relates from the following description of the preferred embodiments described with reference to the accompying drawing forming a part of this specification.

BRIEF SUMMARY OF THE INVENTION

According to principles of the present invention, a construction of whip antenna is provided wherein isolation of its radiating or receiving portion from one of its transmission line terminals takes place above its support fitting. In such an arrangement, any changes in the resistance of the connection between the support fitting and its support structure has no effect on radio transmission or reception. In those instances where the antenna is to be connected to a coaxial transmission line, the whip is fed by the center conductor, and a decoupling transformer is connected to the outside conductor of the coaxial cable, so that the reflected wave from the whip is decoupled from the outside conductor. By so doing the transmission line is prevented from radiating, and the wave reflection in the center conductor of the transmission line is shielded by the outside conductor of the transmission line. In the most preferred embodiment, the decoupling transformer is made by a bifilar winding at the base of the whip. The center conductor from the coaxial transmission line is fed up through one of the bifilar windings and then to the radiating or receiving portion of the whip. The other of the bifilar windings is fed from its tip down through the winding and then to the outside conductor of the coaxial transmission line. This arrangement effectively isolates the center conductor from the outside conductor, and the outside conductor does not need to be grounded adjacent the antenna.

DESCRIPTION OF THE PREFERRED EMBODIMENTS

Figure 1:
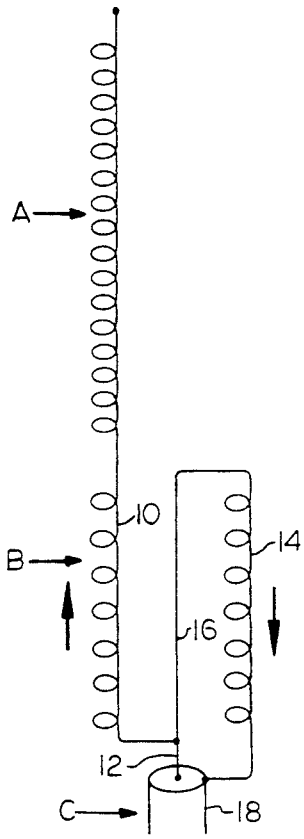
FIG. 1 is a schematic drawing of an antenna embodying principles of the present invention.

FIG. 1 of the drawing is a schematic view of an antenna embodying principles of the present invention. The antenna comprises an electrically resonatable conductor A for transforming electrical pulsations into radio waves and vice versa. The conductor A may be a straight conductor, but is shown coiled so that its length can be made much shorter than if it were a straight conductor. The conductor A is in series with an isolation transformer B which in turn is connected to the two conductors of a coaxial transmission line C. The isolation transformer B may be variously constructed, but is shown as formed by a bifilar winding. One of the bifilar windings 10 is connected between the resonatable conductor A and the center conductor 12 of the coaxial tranmission line C. The other of the bifilar windings 14 has its upper end connected to the center conductor 12 by straight wire 16, and its lower end connected to the outside conductor 18 of the coaxial cable C. By so doing, electrical impulses flow between conductors 12 and 18 to produce opposing fields in the windings 10 and 14. Current flow in winding 14 helps current flow in winding 10, and resists or prevents current flow from winding 10 from entering the outside conductor 18. Therefore, a connection between the outside conductor 18 and ground adjacent the whip antenna is made unnecessary.

Figure 2:
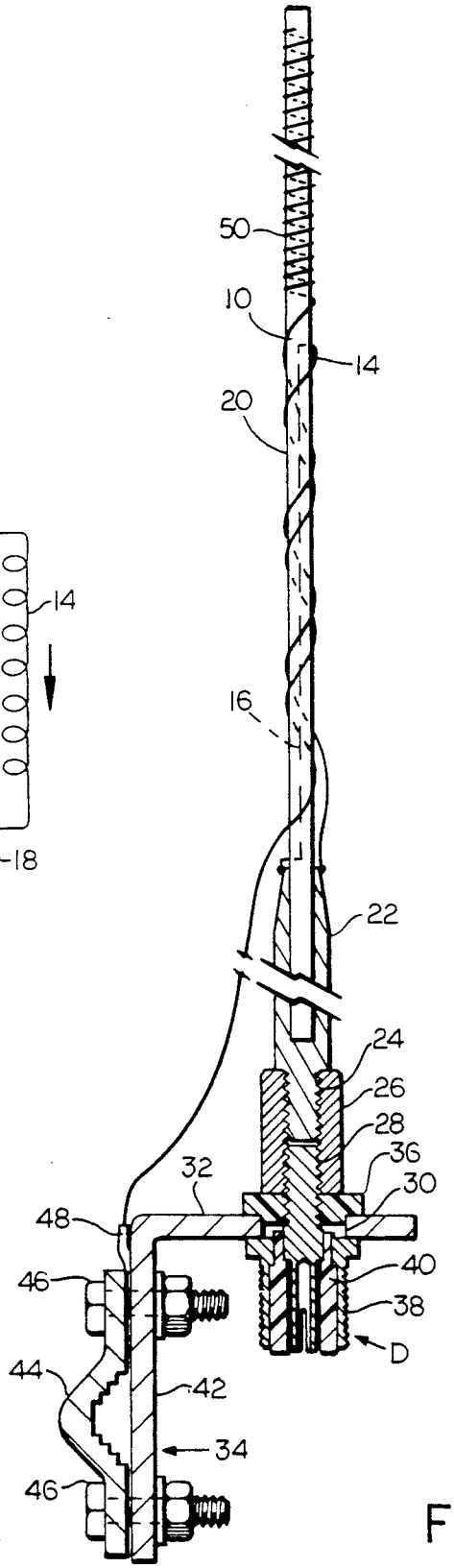
FIG. 2 is a side elevational view, partially sectioned, and with portions broken away so that the various elements of the embodiment can be seen in a single view.

The embodiment shown in FIG. 2 corresponds to the schematic drawing of FIG. 1 and those portions thereof which correspond are so numbered. The embodiment of FIG. 2 has a nonmetallic support rod 20 whose lower end is cemented into a metal sleeve 22. The lower end of metal sleeve 22 has a reduced diameter threaded boss 24, which is threaded into the upper end of an internally threaded coupling 26. The lower end of coupling 26 is in turn threaded onto the center conducting pin 28 of a coaxial cable connector D. The center conducting pin 28 extends through an opening 30 in the horizontal leg 32 of an angle bracket 34, and an anular insulating washer 36 is positioned around the pin 28, and is clamped between the leg 32 and the coupling 26. The cable connector D also includes an externally threaded sleeve 38 which is bonded to the lower end of center pin 28 by a body 40 of nylon or other hard plastic. The upper end of sleeve 38 bears against the under side of leg 32 to support the whip structure from the angle bracket 34. The lower end of pin 28 is tubular and serrated to receive the conventional center pin (not shown) of a coaxial cable connector (not shown) which threads onto the outside of sleeve 38. The lower leg 42 of angle bracket 34 has a hat-shaped clamp 44 and a pair of bolts 46 for confining a support (not shown) between clamp 44 and leg 42.

The nonmetallic support rod 20 has wire 16 embedded therein, with its lower end pulled out and soldered to the upper end of sleeve 22. The upper end of wire 16 is pulled out and soldered to the upper end of bifilar winding 14. The lower end of winding 14 extends down to a transmission line terminal 48 that is connected to one of the bolts 46. The lower end of bifilar winding 10 is also soldered to the upper end of metal sleeve 22. The same wire that forms bifilar winding 10 continues upwardly and is wrapped in tight coils 50 to form the resonatable conductor A for transforming electrical pulses into radio waves and vice versa. The bifilar windings 10 and 14, and the resonatable conductor A, are tightly wound around the support rod 20 and are cemented thereto by a plastic film not shown.

Figure 3:
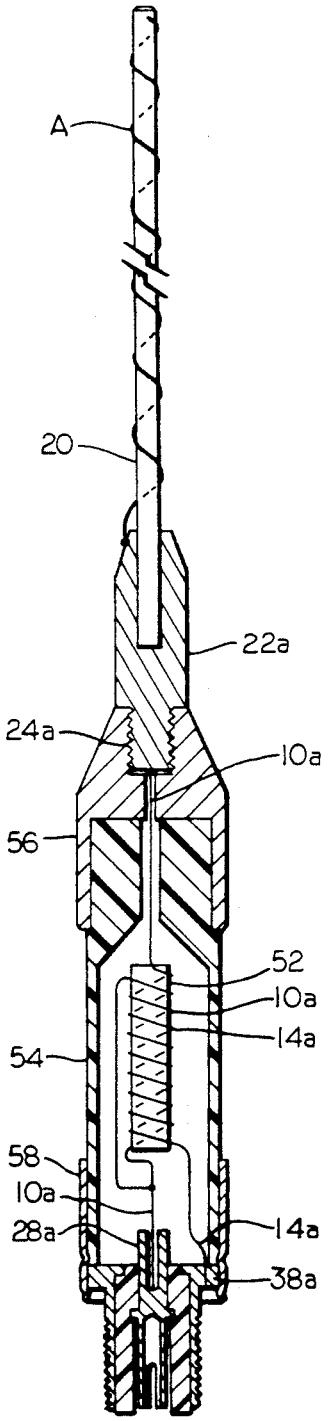
FIG. 3 is a side elevational view, partially sectioned, and with portions broken away so that the various elements of a second embodiment can be seen in a single view.

The embodiment shown in FIG. 3 corresponds generally to the embodiment shown in FIG. 2 to utilize the structure of FIG. 1 but differs therefrom in that its bifilar windings are wound around a permeable core 52. Those portions of FIG. 3 which correspond to portions of FIG. 2 are designated by a like reference numeral, characterized further in that a suffix "a" is affixed thereto. The permeable core 52 is housed axially within a fiber glass support tube 54, the upper end of which is reinforced and cemented into the lower end of a metal sleeve 56. The upper end of sleeve 56 is internally threaded to receive the threaded boss 24*a* of metal sleeve 22*a*. The lower end of fiber glass support tube 54 abuts the top surface of sleeve 38*a*, and is cemented to a section of thin walled tubing 58 that is slipped over the outside of sleeve 38*a*, and crimped thereto to lock the assembly together. The antenna of FIG. 3 can be supported by clamping tube 58 to a suitable vertical support structure. The upper end of winding 10*a* is extended and soldered to the inside of metal sleeve 56. The bottom end of winding 10*a* is soldered to pin 28*a*, and the lower end of winding 14*a* is soldered to sleeve 38*a*. The top of conductor 14*a* is bent down and soldered to the bottom of winding 10*a* adjacent pin 28*a*.

It will be seen that the principles of the present invention can be utilized in a whip antenna for any broadcast band. For the 27 mHZ band, conductor 16 may be approximately 28 inches long, the bifilar windings 10 and 14 each may have a length of approximately 48 inches, and the radiating or radiation absorbing portion A may have a length of approximately 24 feet.

Whip antennas utilizing the above principles may be made for practically any broadcast band providing the length is within reason. The radiating or radiation absorption portion A should be at least a one quarter wave length and preferrably at least a half wave length so that the radiation pattern will be horizontal and slightly downwardly instead of upwardly. Practical antennas of at least a half wave length may be made for the 30 mHZ band, the 6 meter (50 mHZ) band, the 2 meter (144 mHZ) band, and the VHF (150 mHZ) band. The portion of the reflected wave which extends downwardly from portion A is decoupled from the outside conductor 18 of the transmission line by winding 14. Electrical flow through winding 10 induces a voltage in winding 14 which effectively decouples element A from conductor 18. Where a ferrite core 52 is utilized as shown in FIG. 3, the length of the bifilar windings 10*a* and 14*a* may be shortened to as little as approximately 8 turns around a ⅝ inch ferrite core 52 to achieve decoupling.

While the invention has been described in considerable detail, I do not wish to be limited to the particular embodiments shown and described, and it is my intention to cover hereby all novel adaptations, modifications, and arrangements thereof which come within the practice of those skilled in the art to which the invention relates, and which come within the purview of the following claims.

I claim:

1. An antenna whip for handling a transmitted wave energy of generally predetermined wave length comprising: first and second transmission line terminals, said first terminal carrying the transmitted wave: an electrically resonatable antenna element; a decoupling transformer interposed between said antenna element and said transmission line terminals; said decoupling transformer having a first winding connected between said first terminal and said antenna element to cause the transmitted wave from said first transmission line terminal to drive said antenna element; and a second winding interconnecting said first and second terminals in a manner to provide current flow to oppose the transfer of said transmitted wave from said electrically resonatable antenna element to said second transmission line terminal while establishing conductivity between said terminals to cause wave energy to pass in and out of said first transmission line terminal; and means binding said decoupling transformer and antenna element into a structural whip.

2. The antenna whip of claim 1 wherein: said decoupling transformer comprises a pair of bifilar windings with one of said windings being connected in a series circuit between one of said transmission line terminals and said resonatable antenna element, and with the other of said bifilar windings being connected between said other of said transmission line terminals and said series circuit.

3. The antenna whip of claim 2 wherein: said whip includes a permeable member in the magnetic field of said bifilar windings.

4. The antenna whip of claim 2 for use with a coaxial transmission line and wherein: said other of said transmission line terminals is the terminal for the outer conductor of the coaxial transmission line.

5. An antenna whip for handling transmitted wave energy of generally predetermined wave length comprising: first and second transmission line connectors, said first terminal carrying the transmitted wave; a resonatable antenna element; a first transformer winding in series circuit between said first transmission line connector and said resonatable antenna element to cause a wave of transmitted energy to pass between said connector and antenna element; a second transformer winding conductively connected between said series circuit and said second transmission line connector, said second winding being arranged so that current flow therethrough opposes current waves from said antenna element from being conducted to said second transmission line connector; and means binding said antenna element and transformer windings into a structural whip.

6. The antenna whip of claim 5 wherein: said second transformer winding is connected to said series circuit adjacent to its transmission line terminal.

7. An antenna whip for handling transmitted wave energy of generally predetermined wave length comprising: a first transmission line connector for the center conductor of a coaxial cable; a second transmission line connector for the shield of the coaxial cable; a resonatable antenna element; a first bifilar winding electrically connected between said first transmission line connector and said resonatable antenna element to pass current wave energy there between; a second bifilar winding electrically connected between said first and second connectors with current flow to cause said second winding to oppose current waves from said antenna element from being conducted to said second transmission line connector; and means binding said bifilar windings and the antenna element into a structural whip.

8. The antenna whip of claim 7 for the 27 mHZ band in which each bifilar winding is approximately 48 inches long and said antenna element is approximately 24 feet long and wound into a generally tight coil.

9. The antenna whip of claim 7 including a permeable member in the mutual magnetic fields of said bifilar windings.

10. The antenna whip of claim 9 for the 27 mHZ band in which said permeable member is a ferrite core and each bifilar winding has approximately 8 windings around the core.

11. A whip antenna comprising: a structural whip made of electrically nonconducting material and having a conductor embedded therein; a metallic whip support sleeve firmly receiving the lower end of said structural whip with the adjacent end of said conductor being electrically connected thereto; a pair of bifilar windings wrapped around said structural whip over said embedded conductor; a resonatable antenna winding formed by a conductor wound around said structural whip upwardly of said bifilar windings, one of said bifilar windings having its lower end connected to said whip support sleeve and its upper end connected to said resonatable antenna winding, and the other of said bifilar windings having its upper end connected to the upper end of said embedded conductor; said bifilar windings having sufficient length to effectively oppose the electrical waves in said antenna element from passing out of said other bifilar winding.

12. The whip antenna of claim 11 for the 27 mHZ band wherein: said bifilar windings each are approximately 48 inches long, and said resonatable antenna winding is approximately 24 feet long.

13. The whip antenna of claim 11 for the 30 mHZ band wherein: said resonatable antenna winding is at least a half wave length and said bifilar windings are of sufficient length to decouple said antenna winding from said second means.

14. The whip antenna of claim 11 for the 50 mHZ band wherein: said resonatable antenna winding is at least a half wave length and said bifilar windings are of sufficient length to decouple said antenna winding from said second means.

15. The whip antenna of claim 11 for the 144 mHZ band wherein: said resonatable antenna winding is at least a half wave length and said bifilar windings are of sufficient length to decouple said antenna winding from said second means.

16. The whip antenna of claim 11 for the 150 mHZ band wherein: said resonatable antenna winding is at least a half wave length and said bifilar windings are of sufficient length to decouple said antenna winding from said second means.

17. The whip antenna of claim 11 wherein: said bifilar windings each have more than approximately 8 coils around said core to decouple said resonatable antenna element from said shell.

18. A whip antenna comprising; a coaxial cable connector having an outside shell and a center terminal insulated therefrom; an axially extending permeable core upwardly of said center terminal; an antenna whip spaced upwardly of said core; a resonatable antenna element supported by said whip; bifilar windings around said core with one of said bifilar windings having its lower end conductively connected to said center terminal and its upper end connected to said resonatable antenna element, and with the other of said bifilar windings having its upper end conductively connected to said center terminal and its lower end conductively connected to said coaxial cable shell; and means structurally connecting said antenna whip to said coaxial cable shell; said bifilar windings having sufficient length to isolate the standing wave of said antenna element from said coaxial cable shell.

* * * * *